US006602086B2

(12) United States Patent
Tsuji et al.

(10) Patent No.: US 6,602,086 B2
(45) Date of Patent: Aug. 5, 2003

(54) SEMI-COUPLING DETECTION CONNECTOR

(75) Inventors: Masanori Tsuji, Shizuoka (JP); Motohisa Kashiyama, Shizuoka (JP); Takahiro Yoneda, Kanagawa (JP)

(73) Assignee: Yazaki Corporation, Tokyo (JP)

( * ) Notice: Subject to any disclaimer, the term of this patent is extended or adjusted under 35 U.S.C. 154(b) by 251 days.

(21) Appl. No.: 09/858,901

(22) Filed: May 17, 2001

(65) Prior Publication Data

US 2003/0077936 A1 Apr. 24, 2003

(30) Foreign Application Priority Data

May 18, 2000 (JP) ..... 2000-146022

(51) Int. Cl.[7] ..... H01R 13/627
(52) U.S. Cl. ..... 439/352
(58) Field of Search ..... 439/353, 352, 439/489

(56) References Cited

U.S. PATENT DOCUMENTS

| | | | | |
|---|---|---|---|---|
| 5,174,786 A | * 12/1992 | Kato et al. | ..... | 439/489 |
| 5,628,649 A | 5/1997 | Yagi et al. | ..... | 439/489 |
| 5,643,003 A | 7/1997 | Myer et al. | ..... | 439/352 |
| 5,993,238 A | 11/1999 | Kudo et al. | ..... | 439/352 |
| 6,027,364 A | 2/2000 | Fukuda | ..... | 439/489 |

FOREIGN PATENT DOCUMENTS

| | | |
|---|---|---|
| DE | 199 36 450 | 4/2000 |
| EP | 0 899 557 | 1/1999 |
| GB | 2 337 887 | 12/1999 |
| JP | 10289755 | 10/1998 |
| JP | 10-289756 | 10/1998 |
| JP | 10321295 | 12/1998 |
| JP | 10321299 | 12/1998 |
| JP | 11097111 | 4/1999 |
| JP | 11162575 | 6/1999 |

OTHER PUBLICATIONS

Copy of European Patent Office Communication including European Patent Office Search Report for corresponding European Patent application No. 01112271 dated Jul. 27, 2001.

* cited by examiner

*Primary Examiner*—Lynn Feild
*Assistant Examiner*—Phuong K T Dinh
(74) *Attorney, Agent, or Firm*—Armstrong, Westerman & Hattori, LLP

(57) ABSTRACT

A semi-coupling detection connector to detect a semi-coupling state and to ensure an uncoupling operation is provided. A first connector 2 is equipped with an energized slider 4. A second connector 3 is provided with an abutting portion 5 and a locking portion 20. The slider 4 is provided with an abutting arm 24 having an abutting portion 25. The first connector 2 is provided with a locking arm 38, having a locking portion 29, and a guide portion 36. A slide portion 40 is provided on a side of the locking arm 38 near the locking portion 29. The slider 4 is provided with a first guide sloping portion 27 and a second guide sloping portion 28. The slide portion 40 is provided on both sides of the locking arm 38. When the locking portion 29 runs onto the second sloping portion 28, the abutting portion 25 runs onto the guide portion 36, and the abutment of between the abutting portions 5,25 is released. An abutting portion 39 is provided on a bending side of the locking arm 38, an abutting portion 41 is provided on the slider 4, and slant planes 39*a*,41*a* of the respective abutting portions 39,41 abut each other in a locked state of the connectors.

12 Claims, 12 Drawing Sheets

SEMI-COUPLING DETECTION CONNECTOR

BACKGROUND OF THE INVENTION

1. Field of the invention

The present invention relates to a semi-coupling detection connector wherein a semi-coupling state between a first connector and a second connector can be detected by means of a slider arrange inside the first connector in an energized state and wherein a lock release of the connectors can be securely carried out.

2. Description of the Related Art

FIGS. 11–12 shows a conventional semi-coupling detection connector disclosed in Japanese Patent Application Laid-open No. 10-289756.

In FIG. 11, 51 designates a male connector and 52 designates a female connector. The male connector 51 has a female terminal 54 in a connector housing 53 made of synthetic resin, and the female connector 52 has a male terminal 56 in a connector housing 55 made of synthetic resin. The male connector housing 53 has a hood portion 57 made of synthetic resin integrally. The female connector 52 has a connector coupling chamber 58 to make coupling with the male connector housing 53, and a tab portion 56*a* for making contact with the male terminal 56 projects in the connector coupling chamber 58.

In the hood portion 57 of the male connector housing 53, a slider 59 of synthetic resin to detect the connector semi-coupling is provided slidably in a back-and-forth direction (i.e. connector coupling/uncoupling direction). The slider 59 is positioned on the upper side of the male connector housing 53 and is energized forward by a compression coiled spring 60 arranged in the hood portion 57. The slider 59 has an operating projecting portion 61 and a downward stopping projection 62 on the rear end side, a horizontal resilient abutting arm 63 in a middle portion, and a horizontal abutting wall 65 at the front end side. The abutting arm 63 has a downward abutting projection 64 at the front end side, and the abutting projection 64 has a slant plane, for sliding, on the rear side. The abutting arm 63 is vertically bendable.

The hood portion 57 is provided, in a longitudinal middle portion, with an upward guide projection 66 against which a stopping projection 62 of the slider 59 abuts. A resilient locking arm 67 extends in front of the guide projection 66. A downward locking projection 68 to engage an upward locking projection 69 of the female connector 52 is provided on the end of the locking arm 67. An abutting projection 70 for preventing bending is provided over the locking projection 68. The abutting projection 70 abuts on the bottom surface of the abutting wall 65 for checking the upward bending of the locking arm 67.

The female connector 52 is provided with the above locking projection 69 on the rear side of the upper wall of the connector coupling chamber 58. An upward abutting projection 71 for the abutting projection 64 of the slider 59 is provided in front of the locking projection 69. The locking projections 68,69 are arranged in the respective lateral centers of the connectors 51,52. The abutting projection 64 is provided on both sides of the connector 51, and the abutting projection 71 is provided on both sides of the connector 52.

When the connectors 51,52 are initially-coupled from a state of FIG. 11, the abutting projections 64,71 abut on each other, and, further, when both the connectors 51,52 are pushed each other in the coupling direction, the slider 59 is pushed and goes back while compressing a coil spring 60. The abutting wall 65 of the slider 59 separates from the abutting projection 70 of the locking arm 67 backward. And, since the slant plane of the abutting projection 64 slides on the slant plane of the guide projection 66, the abutting arm 63 of the slider 59 bends upward, whereby the abutment of the abutting projections 64,71 is released. And, the locking projections 68,69 of the connectors 51,52 abut on each other thereby to make the locking arm 67 bend upward. Further, the locking projection 68 gets over the locking projection 69 by pressing both the connectors 51,52 in the coupling direction. Simultaneously with the complete coupling of the connectors 51,52 as shown in FIG. 12, the locking projections 68,69 engage each other thereby to lock the connectors 51,52 each other. And, the terminals 54,56 of the respective connectors 51,52 are connected mutually.

In a semi-coupling (i.e. incomplete coupling) state of the connectors 51,52, the slider 59 is being pressed by a coil spring 60 in a connector uncoupling direction. Because the abutting projections 64,71 are in the abutment state, the female connector 52 is pushed out of the male connector 51 by virtue of the coil spring 60. By this, the semi-coupling of the connectors 51,52 can be detected. When the connector 52 is further pushed toward the connector 51, the connectors 51,52 are completely coupled.

With respect to the above prior art semi-coupling detection connector, however, when the connectors 51,52 are to be unlocked, they have to be strongly pulled backward. By this, the engaging plane 68*a* of the locking projection 68 of the male connector 51 slides on the engaging plane 69*a* of the locking projection 69 of the female connector 52, and the locking arm 67 bends upward, thereby releasing the engagement of the locking projections 68,69. This operation needs fairy large force. Therefore, the engaging planes 68*a*,69*a* of the locking projections 68,69 slightly slant in order to lighten the uncoupling force. This, however, causes sudden and easy coming-off of the connectors 51,52.

And, in the semi-coupling of the connectors 51,52, because the locking projection 68 of the locking arm 67 presses the female connector 52 downward due to the restoring force of the locking arm 67 in a state that the locking projection 68 is running onto the locking projection 69 of the connector 52, the sliding friction increases, the force pushing out the female connector 52 by the coil spring 60 weakens, and the detection accuracy of the semi-coupling lowers.

SUMMARY OF THE INVENTION

In view of the foregoing, an object of the present invention is to provide a semi-coupling detection connector with a slider for detecting a connector semi-coupling state, wherein a pair of connectors can be securely locked, the connector uncoupling work can be carried out smoothly and easily with a small force, and the connector semi-coupling detection can be carried out accurately.

In order to achieve the above object, as a first aspect of the present invention, a semi-coupling detection connector comprises: a first connector having a resilient locking arm; a second connector having a first locking portion and being to be coupled with the first connector; and a slider provided on the first connector slidably in a connector coupling/uncoupling direction, wherein a second locking portion for the first locking portion is provided on the locking arm, a slide portion is provided, near the second locking portion, on a side portion of the locking arm, and a first guide sloping portion for the slide portion and a second guide sloping portion for the second locking portion are provided on the slider in a connector coupling direction.

As a second aspect of the present invention, based on the first aspect, the slider is energized in the connector coupling direction.

As a third aspect of the present invention, based on the first aspect, the slide portion is provided on both sides of the locking arm.

As a fourth aspect of the present invention, based on the first aspect, a resilient abutting arm having a second abutting portion for the first abutting portion of the second connector is provided on the slider, the second abutting portion runs onto a guide portion of the first connector when the second locking portion runs onto the second sloping portion, and abutment between the second abutting portion and the first abutting portion is released.

As a fifth aspect of the present invention, based on the second aspect, a third abutting portion is provided on a bending side of the locking arm, an abutting portion for the third abutting portion is provided on the slider, and a slant plane of the abutting portion abuts another slant plane of the third abutting portion under the energization in an engaged state of the first and second locking portions.

As a sixth aspect of the present invention, based on the second aspect, a stopping portion is provided on the slider, and the stopping portion abuts the guide portion under the energization.

As a seventh aspect of the present invention, based on any one of the previous aspects, the first and second locking portions each have an engaging plane being vertical or slanted in a direction of hard unlocking.

Action due to the above structure is described hereinafter.

By pressing both the connectors in the coupling direction (forward), the first abutting portion pushes the second abutting portion backward thereby to make the slider go back. Along with this, the first guide sloping portion of the slider picks up the slide portion of the locking arm, and the locking arm bends a little when the slide portion shifts along the first guide sloping portion. Next, the second guide sloping portion picks up the second locking portion of the locking arm, and the locking arm bends largely when the second locking portion shifts along the second guide sloping portion. That is, the second locking portion separates from the first guide portion in a locking arm bending direction. Subsequently, since the second abutting portion of the slider runs onto the guide portion, the abutting arm bends, the abutment between the first abutting portion and the second abutting portion is released, and the slider returns forward. Then, the abutment between the second locking portion and the second guide sloping portion is released instantly, and the locking arm is restored. And, the second locking portion engages the first locking portion, whereby the connectors are locked and completely couple with each other simultaneously.

When the connector is in a semi-coupling (incomplete coupling) state, both the locking portions do not engage each other. And, since both the abutting portions are abutting, the first abutting portion is pushed with the force, by which the slider is energized forward, in the connector uncoupling direction (backward), and the second connector is pushed out. Like this, the connector semi-coupling is detected.

For uncoupling both the connectors, the slider is slide toward the connector uncoupling direction (backward). Thereby, similarly to the above, the first sloping portion picks up the slide portion of the locking arm, and subsequently the second sloping portion picks up the second locking portion, whereby the locking arm is forcibly bent and thereby the engagement of both the locking portions is released. Both the connectors are uncoupled by being pulled in the connector uncoupling direction.

According to the above-described structures of the present invention, the following advantages are provided.

(1) Because the engagement of the locking portions of the connectors is released by forcibly bending the locking arm by means of the first guide sloping portion and the second guide sloping portion in turn, the connectors can be easily uncoupled only by lightly pulling them in the uncoupling direction. Therefore, the engaging planes of the locking portions need not to be slanted in an easily disengageable direction, thereby strengthening the locking force and preventing sudden coming-out or slipping-off of the connectors. And, because firstly the slide portion of the locking arm is picked up by the first guide sloping portion and subsequently the second locking portion is picked up by the second guide sloping portion, the locking arm can be securely and largely bent. Therefore, the contact of both guide portions can be prevented during the connector coupling operating, the force for the connector coupling operation can be reduced because of the reduction of sliding friction, thereby facilitating the coupling operation with a smaller force.

(2) Because the pressing force of the slider just acts as a pushing-out force of the second connector, the second connector can be securely pushed out at the connector semi-coupling state, thereby improving the connector semi-coupling detection accuracy.

(3) Because the slide portion is arranged on both sides of the locking arm, the locking arm does not twist when the first guide sloping portion picks up the slide portion, thereby stabilizing the bending operation of the locking arm.

(4) In the connector coupling operating, the second locking portion runs onto the second guide sloping portion, the locking arm bends large, and the abutment of the first and second abutting portions is released. And, the slider returns elastically, and the abutment of the second locking portion and the second guide sloping portion is released. Therefore, the locking arm is restored in the original state, the second locking portion securely engages the first locking portion, and the connectors can be securely locked each other.

(5) Because the slant plane of the third abutting portion of the locking arm is pressed by the slant plane of the abutting portion of the slider in a direction opposite the bending direction of the locking arm in the locked state of the connectors, bending of the locking arm is securely checked, and a sudden lock coming-off can be securely prevented.

(6) Because the stopping portion of the slider abuts the guide portion of the first connector under the energization, a restoration position of the slider can be accurately defined.

(7) Because the both locking portions each having a vertical or hard-unlocking slanted engaging plane engage each other, the locking force can be improved, thereby further securely preventing the sudden lock coming-off. Because the engagement of the locking portions of the connectors is released by forcibly bending the locking arm by means of the first guide sloping portion and the second guide sloping portion in turn, the connectors can be easily uncoupled only by lightly pulling them in the uncoupling direction in spite of the vertical or hard-unlocking slanted engaging planes.

The above and other objects and features of the present invention will become more apparent from the following description taken in conjunction with the accompanying drawings.

DESCRIPTION OF THE PREFERRED EMBODIMENT(S)

An embodiment of the present invention will now be described in further detail with reference to the accompanying drawings.

Figure 1:
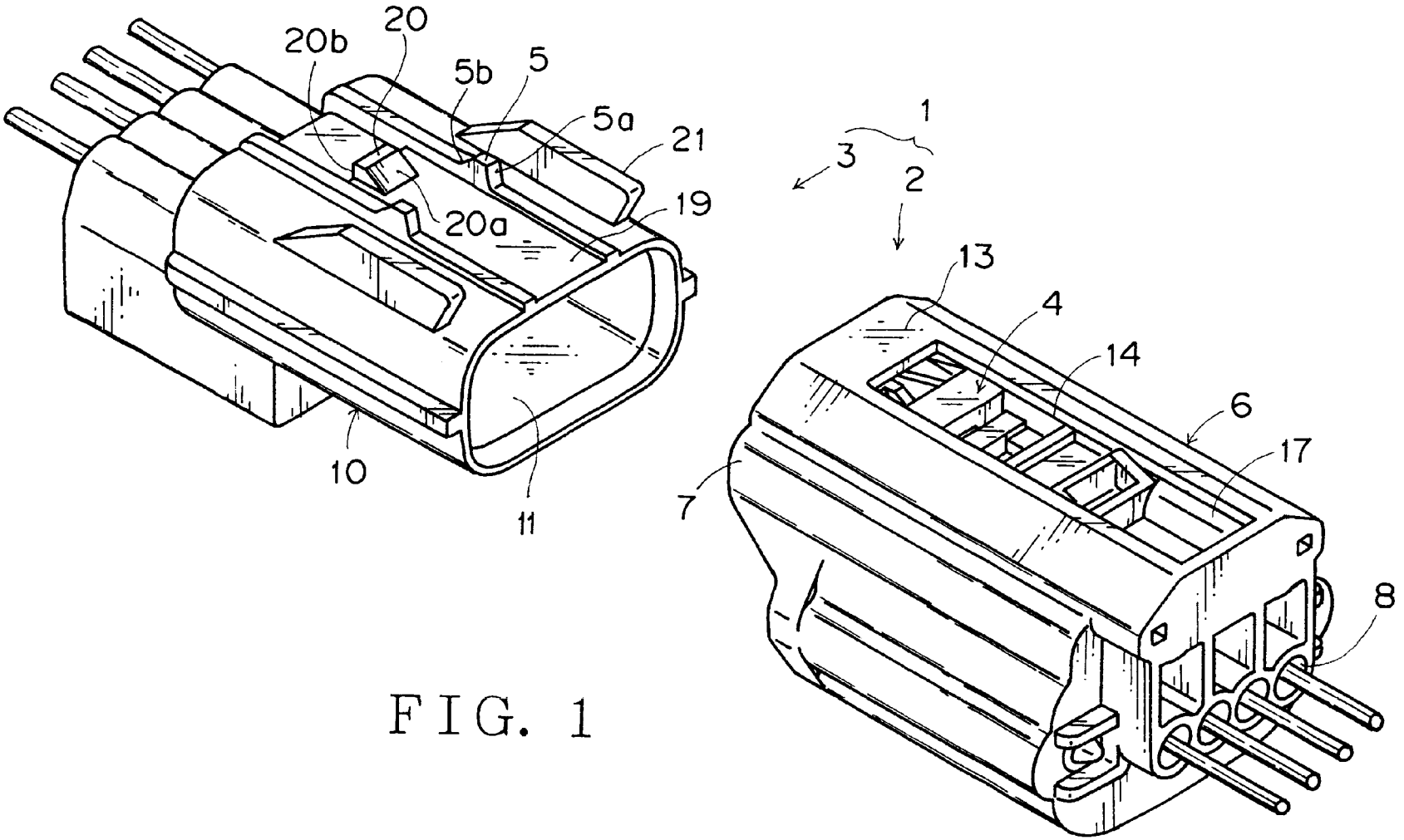
FIG. 1 is an exploded perspective view showing an embodiment of the semicoupling detection connector in accordance with the present invention.

FIG. 1 is an exploded perspective view showing an embodiment of the semicoupling detection connector in accordance with the present invention.

The semi-coupling detection connector 1 is made up of a male connector 2 having a slider 4 of synthetic resin to detect a semi-coupling state, a female connector 3 having a pair of abutting projections (abutting portions) 5 to be pressed by the slider 4. The male connector 4 has a connector housing 6 of synthetic resin having the hood portion 7 and a female connector 9 (FIG. 3) inserted and engaged inside a terminal accommodating chamber 8 of the connector housing 6. The female connector 3 has a connector housing 10 of synthetic resin having a connector coupling chamber 11 and a male connector 12 (FIG. 3) accommodated in the rear half side of the connector housing 10.

Figure 2:
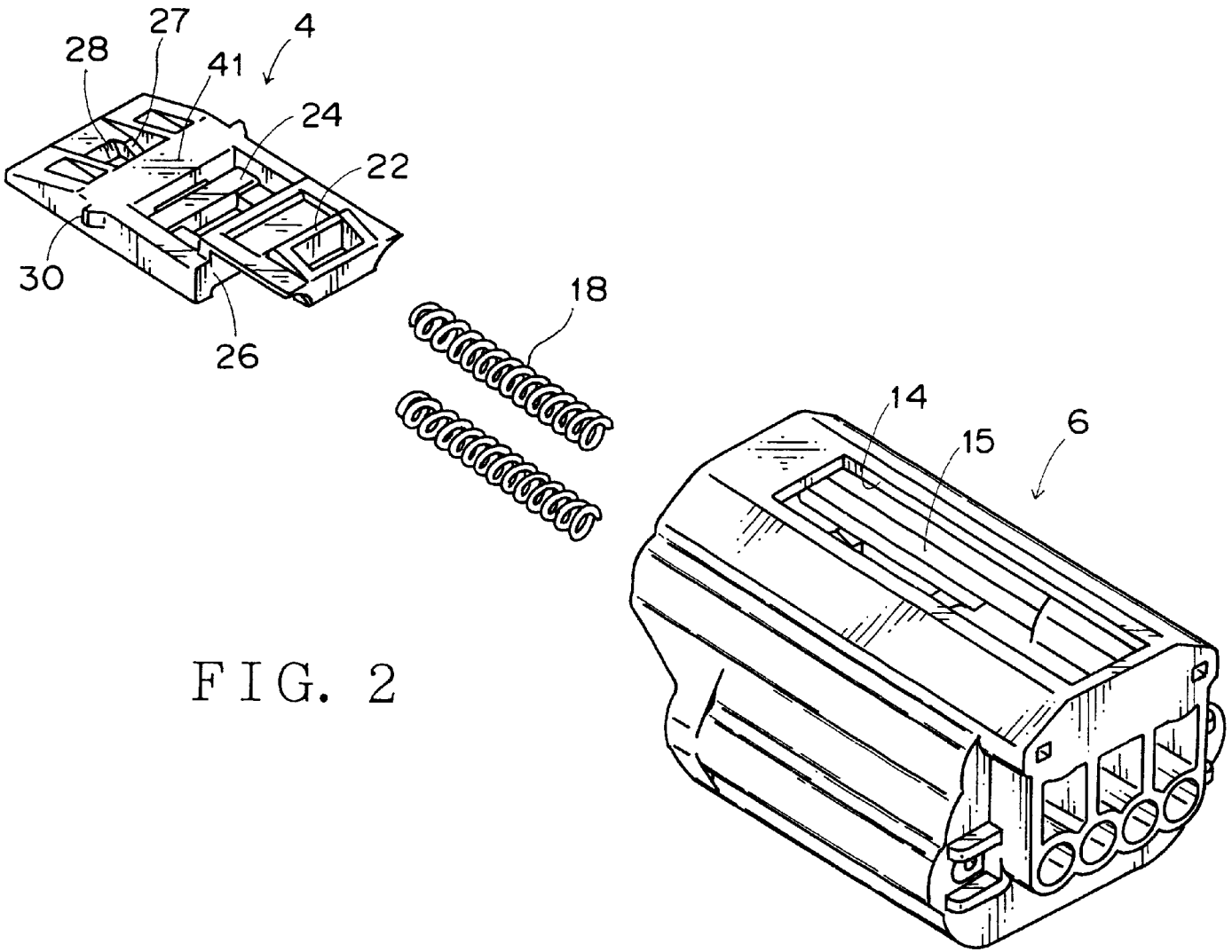
FIG. 2 is an exploded perspective view showing the male connector.

A rectangular opening 14 is provided on the upper wall 13 of the hood portion 7 of the male connector 2, and the slider 4 is inserted into the inside space 15 (FIG. 2) of the opening 14 from the front opening 16 (FIG. 3) slidably in a back-and-forth direction. As shown in FIG. 2, a right and left pair of spring receiving portions 17 are formed on the rear end side in the opening 14. A compression coiled spring 18, namely an elastic member (FIG. 2), is inserted in the spring receiving portion 17 from the front opening 16 (FIG. 3).

The female connector housing 10 is provided with the pair of abutting projections 5 at a longitudinal middle portion of the upper wall 19 in parallel. On the rear side of the abutting projections 5, a locking projection (locking portion) 20 for the male connector 2 is provided at the lateral center of the upper wall 19. The abutting projection 5 has a front-side vertical abutting plane 5*a* and a rear-side vertical slant plane 5*b*. The locking projection 20 has a front-side slant plane 20*a* and a rear-side vertical engaging plane 20*b*. A projecting wall 21 for positioning against the male connector 2 is provided on the outside of each abutting projection 5.

As shown in FIG. 2, the slider 4 has an upward projecting portion 22 for setback operation on the rear side, a stopping projection (stopping portion) 23 (FIG. 3) under the projecting portion 22, and a U-shaped resilient abutting arm 24 in the middle portion. A pair of abutting projections (second abutting portion) 25 (FIG. 3) are provided downward on the respective right and left sides of the front end of the abutting arm 24. The base portion of the abutting arm 24 is positioned inside the rear step portion 26, and the front end of coil spring 18 abuts the rear step portion A pair of first guide sloping portions 27 are formed on the front-side of the slider 4, and a second guide sloping portion 28 is formed inside and at the front side of the first guide sloping portions 27. Both guide sloping portions 27,28 are downwardly slanted rearward, and an angle of inclination of the second guide sloping portion 28 is steeper than that of the first guide sloping portion 27. A pair of guide grooves (not shown) are formed on the under surface of the slider 4 from the front end toward the above abutting projections 25 (FIG. 3). The abutting projection 5 of the female connector housing 10 (FIG. 1) enters the guide groove. The locking projection (the first locking portion) 20 of the female connector housing 10 (FIG. 1) is positioned relative to the downward locking projection (the second locking portion) 29 of the male connector housing 6 (FIG. 3). A stopping projection 30 for preventing forward coming-off is provided on each side of the middle portion of the slider 4.

Figure 3:
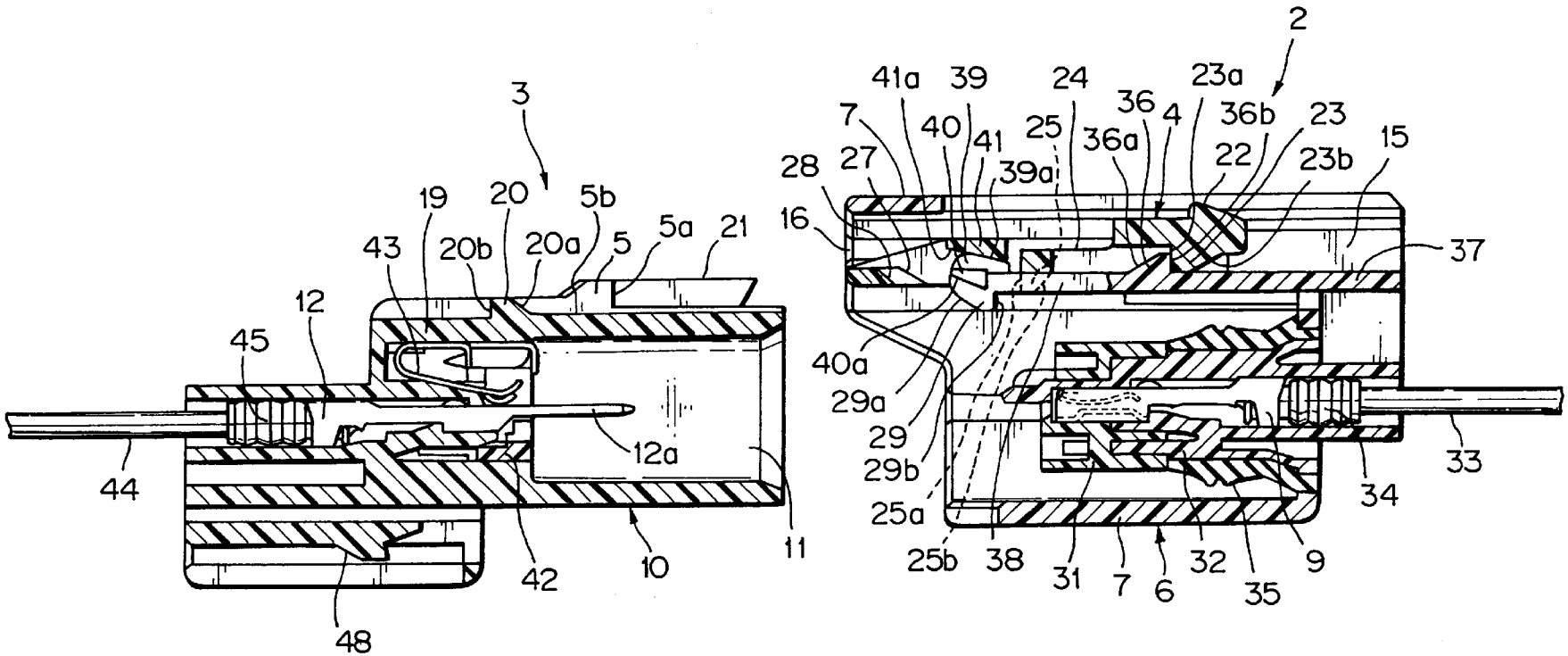
FIG. 3 is a longitudinal sectional view of the semi-coupling detection connector.

As shown in FIG. 3, the male connector 2 has an inside housing 32 with a front holder 31 inside the hood portion 7 and the female connector 9 with the wire 33 inside the inside housing 32. A waterproof rubber stopper 34 is applied outside the wire 33, and a packing 35 is arranged outside the inside housing 32. The slider 4 is set in the upper portion inside the hood portion 7 slidably in a back-and-forth direction (the connector coupling/uncoupling direction).

The slider 4 is energized by the coil spring 18 (FIG. 2) forward (the connector coupling direction). 22 designates a projecting portion to operate the slider, 23 is a stopping projections. The stopping projection 23 has a vertical abutting plane 23*a* on the front side and a slant plane 23*b* on the rear side. The slant plane 23*b* is provided for smoothly getting over the guide projection (the guide portion) 36 of the hood portion when the slider 4 is set into the hood portion 7. The guide projection 36 is upwardly arranged on the horizontal intermediate wall 37 at the longitudinal middle portion thereof in the hood portion 7. A slider accommodating space 15 is provided above the intermediate wall 37. A resilient locking arm 38 is formed in the front half side of the intermediate wall 37 by cutting out the periphery of the locking arm portion.

The locking arm 38 has a downward locking projection (a second locking projection) 29 and an upward abutting projection (a third abutting portion) 39 at the front end. The locking arm 38 also has a pair of slide projections (slide portions) 40 for releasing the connector lock on both sides of the front end portion. The locking projection 29 has a front-side slant plane 29*a* and a rear-side engaging plane 29*b* which is vertical or a little sloping forward from its root portion. The abutting projection 39 has a slant plane 39*a* upwardly facing and upwardly sloping from the root thereof, and the slide projection 40 has a slant plane 40*a* downwardly facing and downwardly sloping from the front end thereof. The front end portion of the locking arm 38 is positioned almost in the middle of the front end of the hood portion 7 and the front end of the intermediate housing 22.

The slider 4 has the generally U-shaped resilient abutting arm 24 in the middle portion thereof, the abutting wall (abutting portion) 41 in front of the abutting arm 24, the first guide sloping portion 27 in front of the abutting wall 41, and the second guide sloping portion 28 in front of the first guide sloping portion 27. The abutting arm 24 has a downward abutting projection (second the abutting projection) 25 at the front end side, and the abutting projection 25 has a front-side vertical abutting plane 25*a* and a rear-side slant plane 25*b*.

In a state of the stopping projection 23 abutting the guide projection 36, the abutting projections 25 are positioned behind the locking projection 29, and the bottom of the abutting projection 25 is positioned in the same plane as the under surface of the locking arm 38. The abutting wall 41 has a slant plane 41*a* downwardly facing and downwardly sloping from the front end and is formed in a wedged shape, which slant plane 41*a* slidingly contacts with the abutting projection 39 of the locking arm 38. The first guide sloping portion 27 is positioned in front of the slide projection 40 of the locking arm 38. The second guide sloping portion 28 is positioned opposite the front end of the locking arm 38 obliquely above the locking projection 29.

The female connector 3 has the abutting projection (the first abutting projection) 5 on the upper wall 19 of the connector housing 10 and the locking projection (the first locking projection) 20 behind the abutting projection 5. The abutting projection 5 has the front-side vertical abutting plane Sa and the rear-side vertical slant plane 5*b*. The locking projection 20 has a front-side slant plane 20*a* and a rear-side engaging plane 20*b* vertically or a little forwardly sloping from the root. The abutting projections 5 face the abutting projections 25 of the abutting arm 24 of the above male connector 2, and the locking projection 20 faces the locking projection 29 of the locking arm 38.

In the female connector housing 10, the rear half portions of the male terminals 12 are accommodated in the respective terminal accommodating chambers sectioned by a front holder 42. Tab portions 12*a* of the front half portions of the terminals 12 project in the connector coupling chamber 11. Each terminal 12 is connected by a conductive short spring 43. A waterproof rubber stopper 45 is arranged over the wire 44 pressure-welded to the terminal 12. The lower part of the connector housing 10 is fixed to a vehicle body or equipment (not shown) by a fixed arm 48.

Action of the above semi-coupling detection connector 1 is described referring to FIGS. 4–10.

Figure 4A:
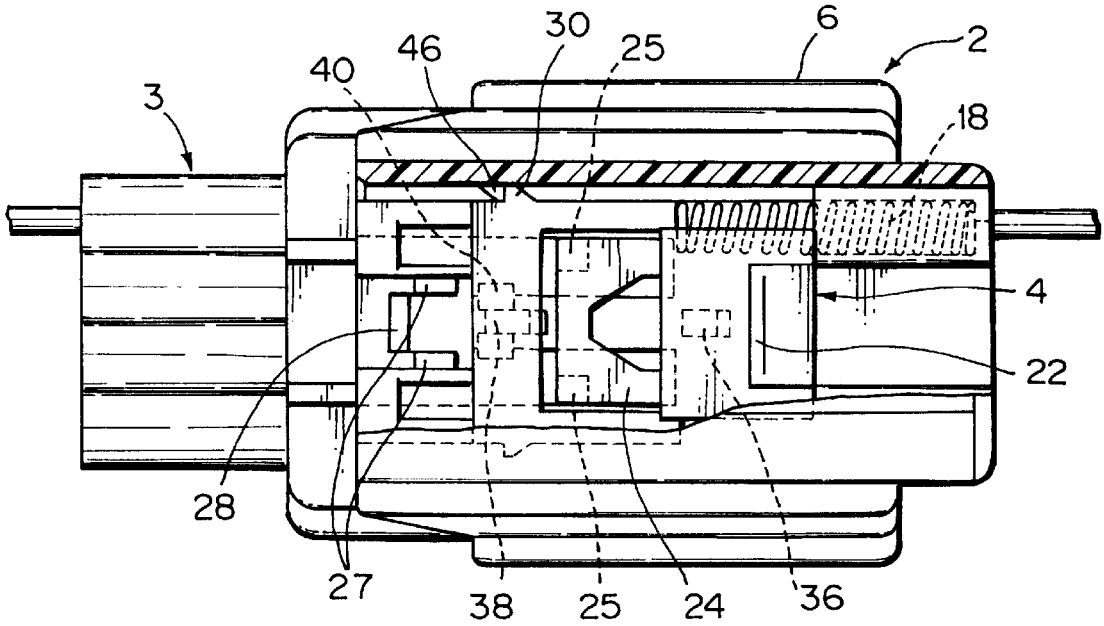
FIG. 4A is a plan view showing an initial coupling state of the semi-coupling detection connector.
Figure 4B:
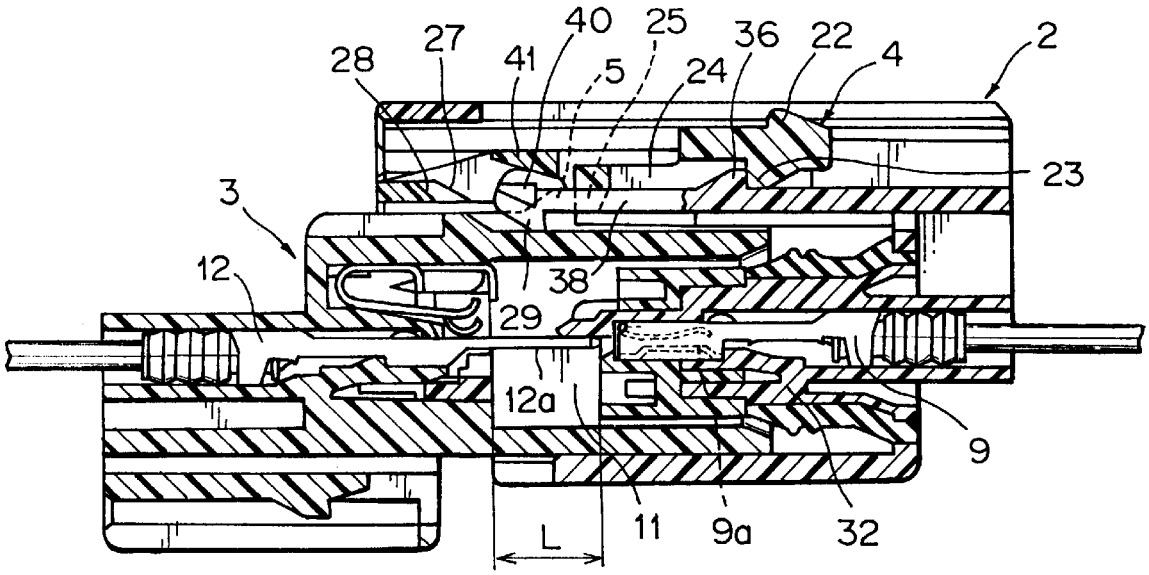
FIG. 4B is the longitudinal sectional view.

In FIG. 4, the male connector 2 and the female connector 3 initially-couples with each other, wherein the abutting projection 5 of the female connector 3 begins to abut the abutting projection 25 of the abutting arm 24 of the slider 4. The tab portion 12*a* of the male connector 12 is not yet put into contact with the electrically contacting portion 9*a* of the female connector 9, and a large gap L exists between the bottom of the connector coupling chamber 11 and the front end of the inside housing 32.

The slider 4 is energized by the coil spring 18 forward (the connector coupling direction). The coil spring 18 remains pre-compressed a little. The stopping projections 30 on both sides of the slider 4 abut the respective stopping projections 46 of the male connector housing 6, and the stopping projection 23 abuts the guide projection 36, whereby the front end position of the slider 4 is decided.

Figure 5A:
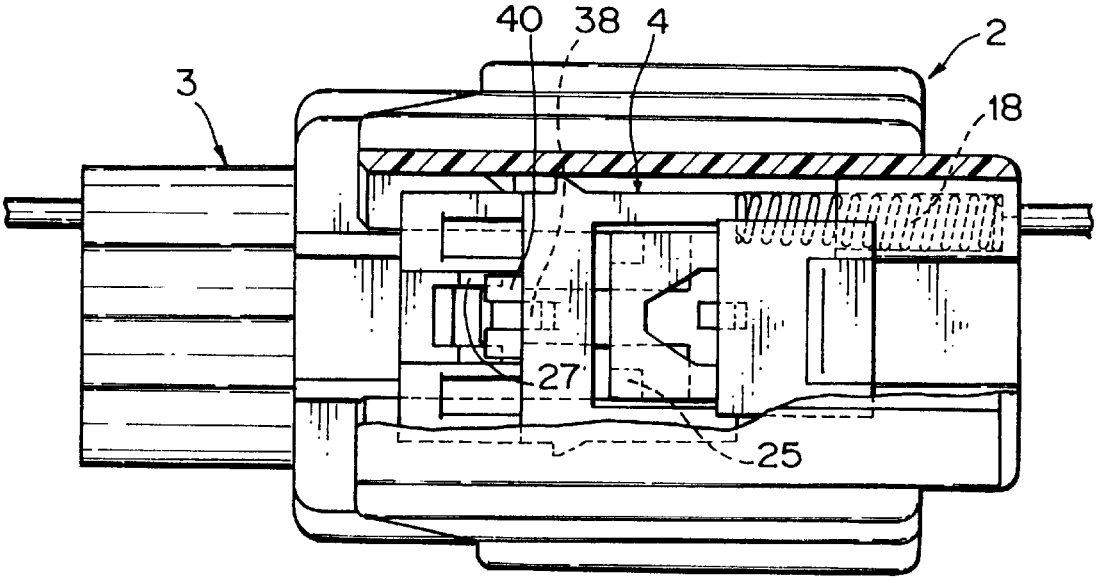
FIG. 5A is a plan view showing a lock starting state of the semi-coupling detection connector.
Figure 5B:
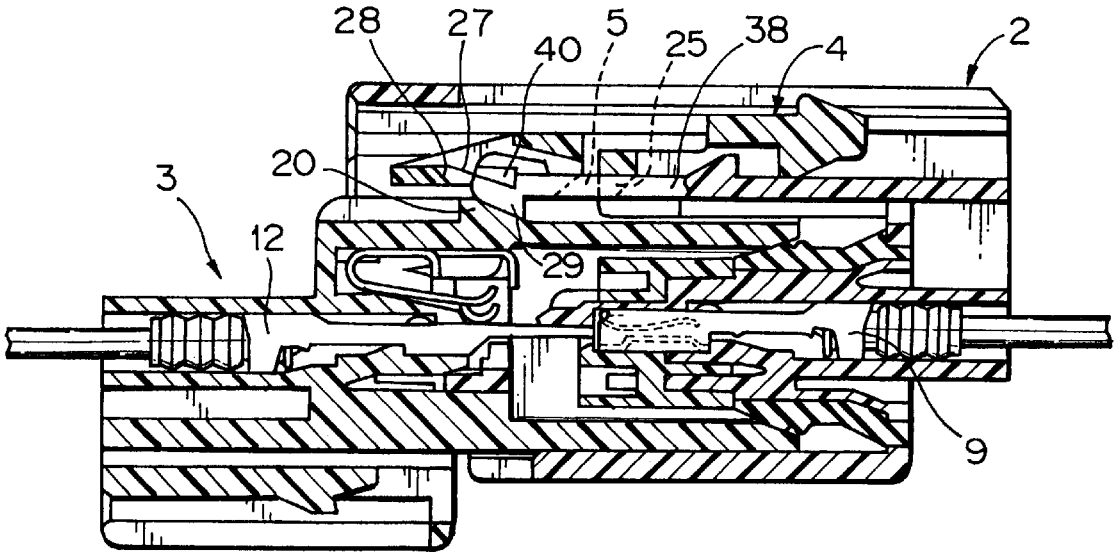
FIG. 5B is the longitudinal sectional view.

And, as shown in FIG. 5, the abutting projection 25 of the slider 4 is pushed by the abutting projection 5 of the female connector 3, whereby the slider 4 goes back while compressing the coil spring 18. The locking projection 20 of the female connector 3 abuts the locking projection 29 of the locking arm 38 of the male connector 2. The first guide sloping portion 27 of the slider 4 is put into contact with the slide projection 40 of the locking arm 38. The slide projection 40 rises along the first guide sloping portion 27, and the locking arm 38 bends upward. Both the terminals 9,12 are starting the contact.

Figure 6A:
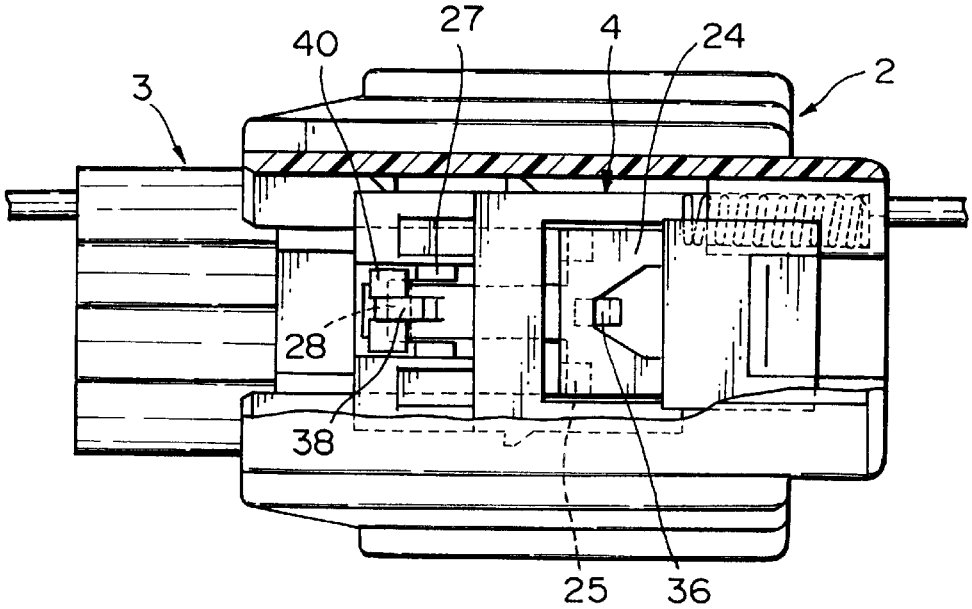
FIG. 6A is a plan view showing a state just before the lock of the semi-coupling detection connector.
Figure 6B:
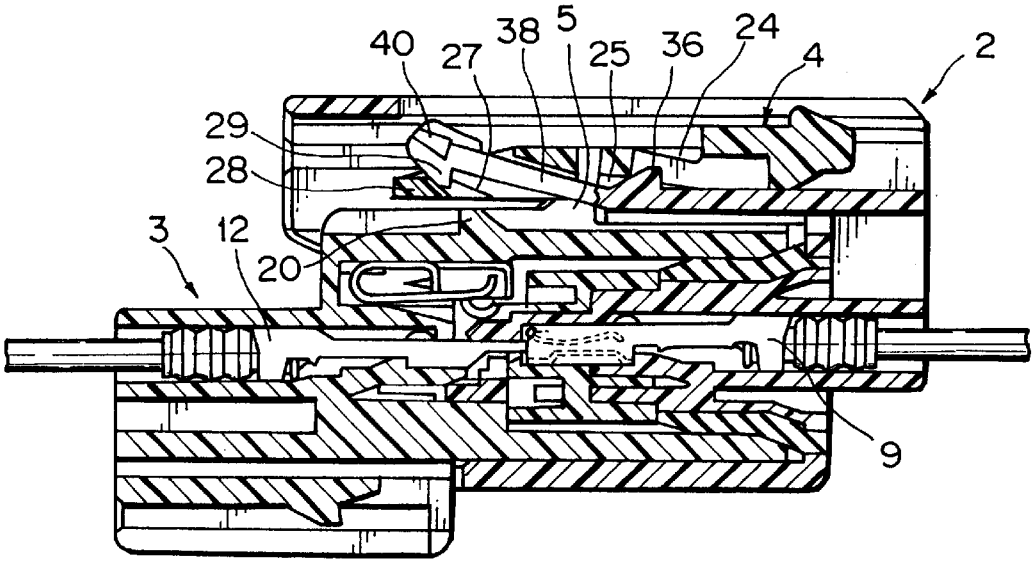
FIG. 6B is the longitudinal sectional view.

With the slider 4 going back as shown in FIG. 6, the locking projection 29 of the locking arm 38 slides upward on the second guide sloping portion 28, while the locking arm 38 bends further upward. And, the locking projection 29 of the locking arm 38 passes over the locking projection 20 of the female connector 3.

The slide projection 40 goes up along the first guide sloping portion 27, which make the locking projection 29 come into contact with the second guide sloping portion 28, whereby the locking arm 38 is bent largely. And, the abutting projection of the slider 4 slides on the guide projection 36 of the male connector 2, which makes the abutting arm 24 bend upward, whereby the abutment of the abutting projection 25 against the abutting projection 5 of the female connector 3 is released. In a state of FIG. 6, both the connectors 2,3 have been completely coupled, and both the terminals 9,12 are completely put into contact with each other.

Figure 7A:
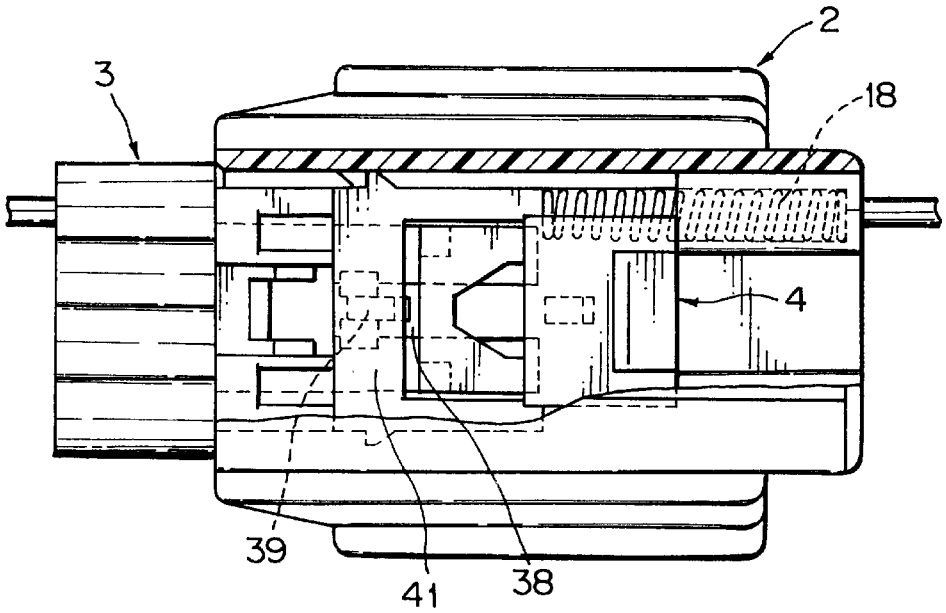
FIG. 7A is a plan view showing a completely coupled state of the semi-coupling detection connector.
Figure 7B:
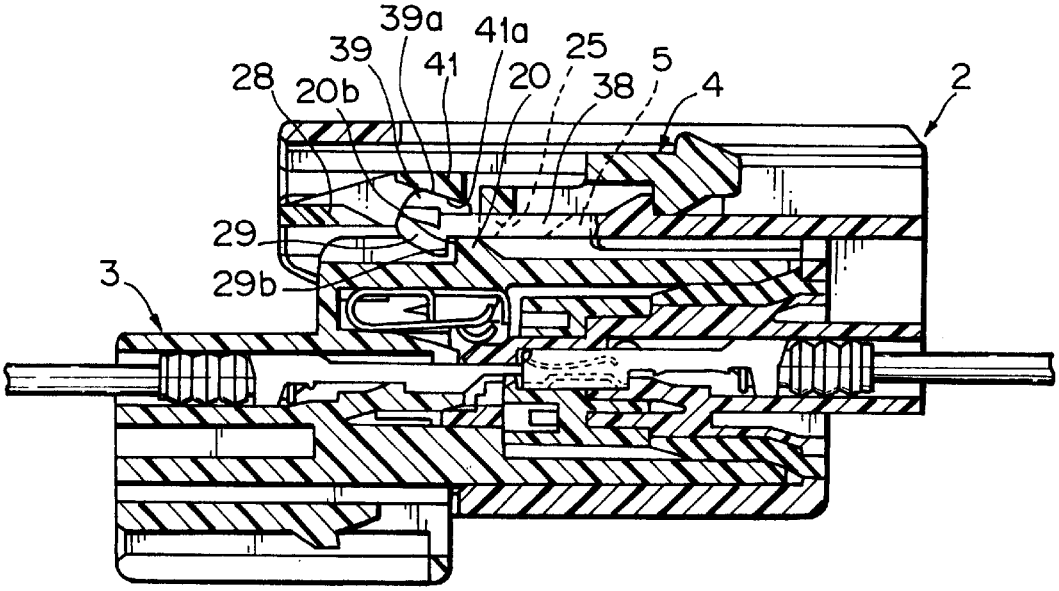
FIG. 7B is the longitudinal sectional view.

With the release of the abutment of the abutting projections 5,25, the slider 4, as shown in FIG. 7, is pushed back by the coil spring 18 forward and returns to the initial state of FIG. 3. The abutting projection 25 of the slider 4 gets over the abutting projection 5 of the female connector 3 and shifts forward. Since the second guide sloping portion 28 of the slider 4 shifts forward, the abutment between the second guide sloping portion 28 and the locking projection 29 of the locking arm 38 is released. The locking arm 38 is elastically restored to the original state in a horizontal direction, and the locking projection 29 engages the locking projection of the female connector 3. That is, the engaging planes 20*b*,29*b* of the locking projections 20,29 engage each other, and both the connectors 2,3 are locked.

In this state, the abutting wall 41 of the slider 4 abuts the upper slant plane 39*a* of the abutting projection 39 of the locking arm 38 thereby to prevent the locking arm 38 from bending upward. Since the slider 4 is energized by the coil spring 18 forward and the slant plane 41*a* of the abutting wall 41 is pushed toward the slant plane 39*a* of the abutting projection 39, sudden release of the lock of the connectors can be securely prevented.

When an operator stops coupling the connectors in the connector semi-coupling state of FIG. 5, because the abutting projection 25 of the slider 4 abuts the abutting projection 5 of the female connector 3, the female connector 3 is pushed back from the male connector 2 by the compressive force of the coil spring 18, whereby the connector semi-coupling can be detected. This is similar in a state of FIG. 6.

In the process of FIGS. 5 and 6 especially, because the locking arm 38 is lifted along the second guide sloping portion 27 and the contact between the locking projections 20,29 disappears, the frictional resistance decreases, whereby the female connector 3 can be smoothly and securely pushed back by virtue of the coil spring 18, that is, a semi-coupling detection accuracy of the connectors is improved.

Figure 8A:
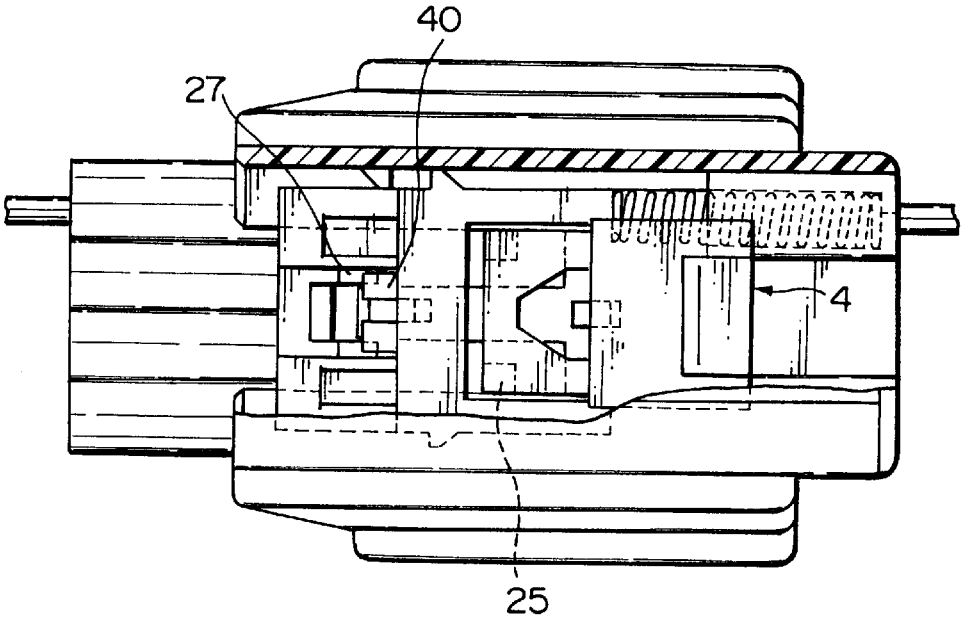
FIG. 8A is a plan view showing a lock release starting state of the semi-coupling detection connector.
Figure 8B:
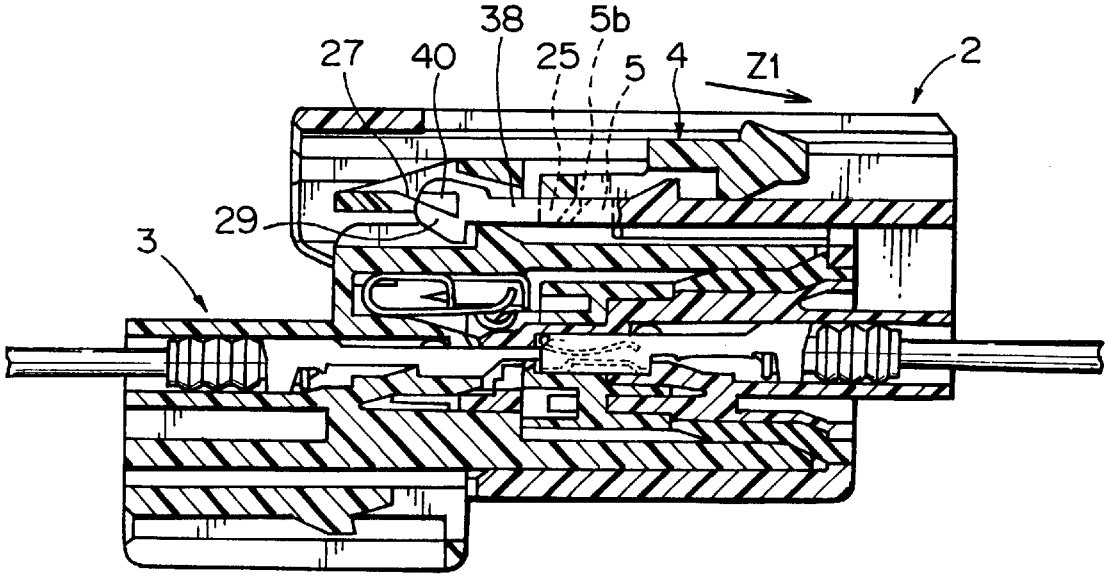
FIG. 8B is the longitudinal sectional view.

As for the way of uncoupling the connectors 2,3 from the coupled state of FIG. 7, the projecting portion 22 (FIG. 9) for operating the slider 4 is pulled backward in the arrow Z1 direction (the connector uncoupling direction) as shown in FIG. 8 to make the slider 4 go back. Then, the first guide sloping portion 27 of the slider 4 slides along the slide projection 40 of the locking arm 38. Further, the rear-side slant plane 25*b* of the abutting projection 25 of the slider 4 slides along the rear-side slant plane 5*b* of the abutting projection 5 of the female connector 3.

Figure 9A:
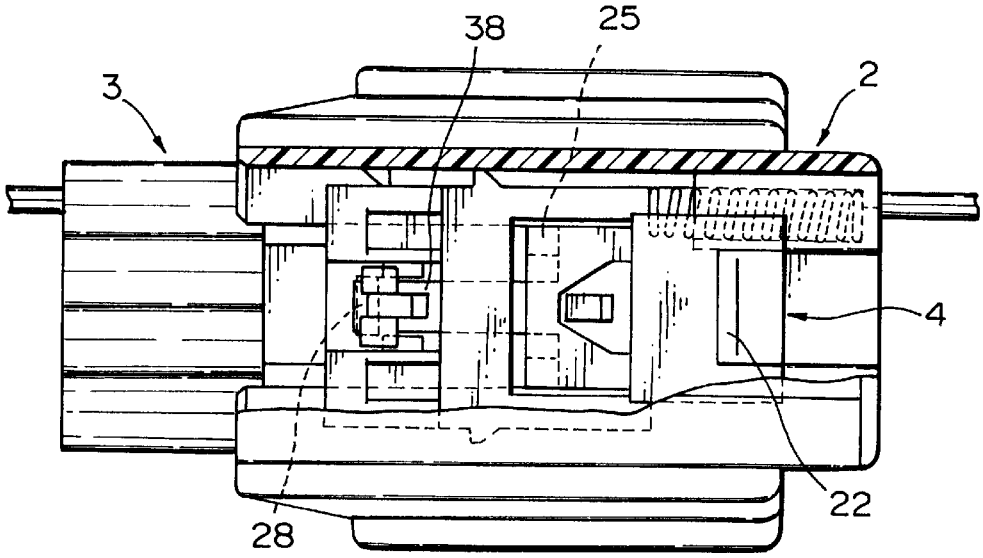
FIG. 9A is a plan view showing a state of releasing the lock of the semi-coupling detection connector.
Figure 9B:
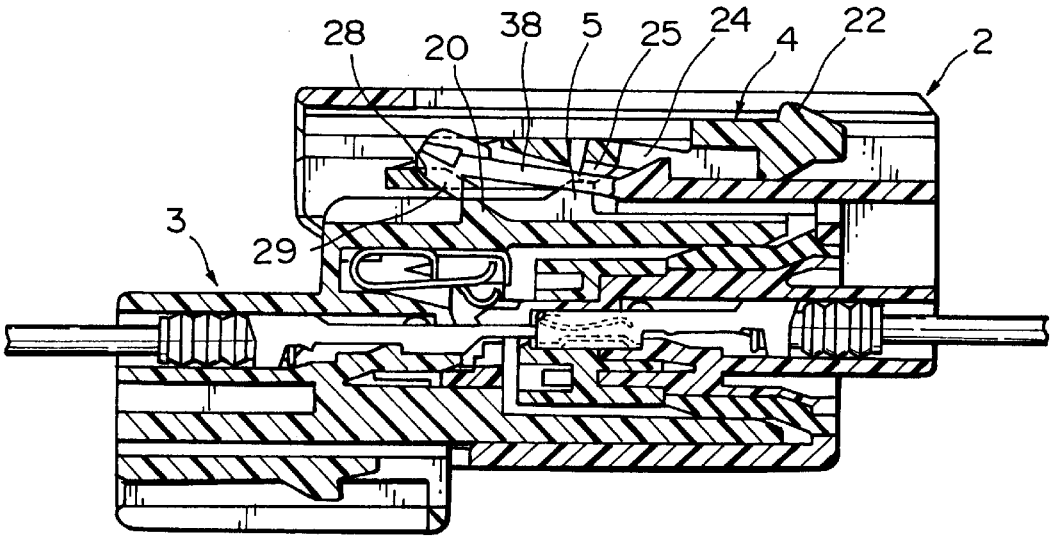
FIG. 9B is the longitudinal sectional view.

And, the locking projection 29 of the locking arm 38, as shown in FIG. 9, is pushed up by the second guide sloping portion 28 of the slider 4, and the locking arm 38 bends largely upward. Simultaneously, the abutting projection 25 of the abutting arm 24 runs onto the abutting projection 5 of the female connector 3 while sliding thereon. The locking projections 20,29 separate from each other up and down thereby to release the lock of the connectors 2,3.

Figure 10A:
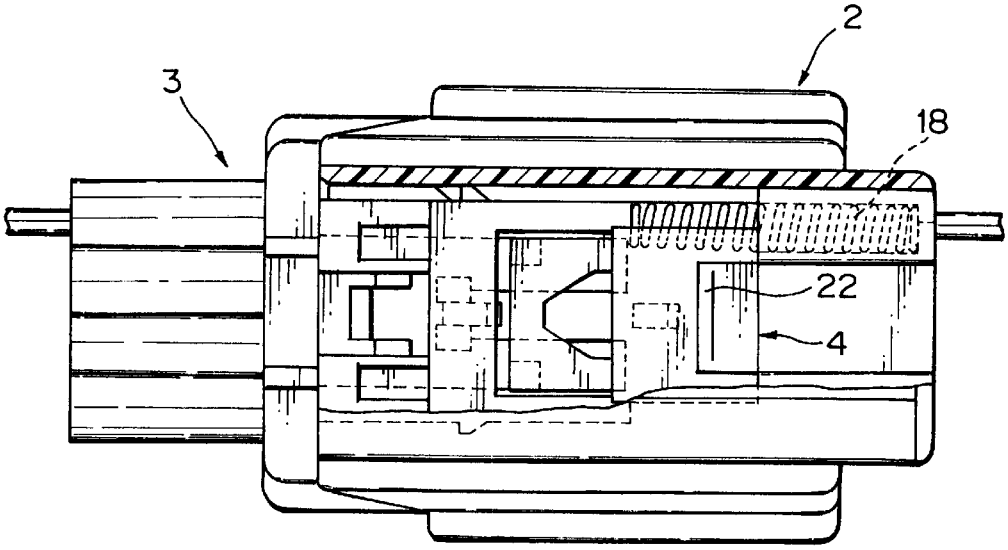
FIG. 10A is a plan view showing an uncoupling state of the semi-coupling detection connector.
Figure 10B:
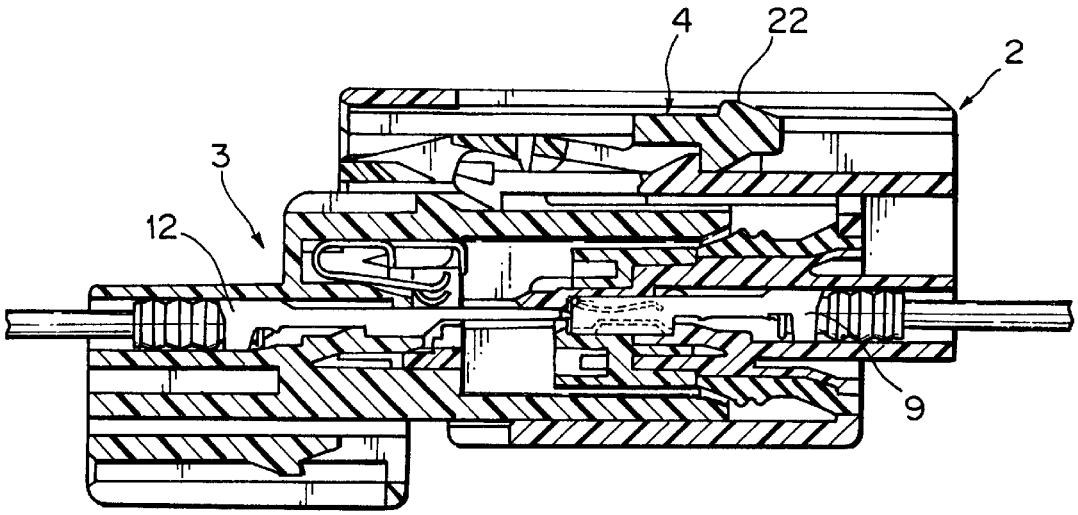
FIG. 10B is the longitudinal sectional view.
Figure 11:
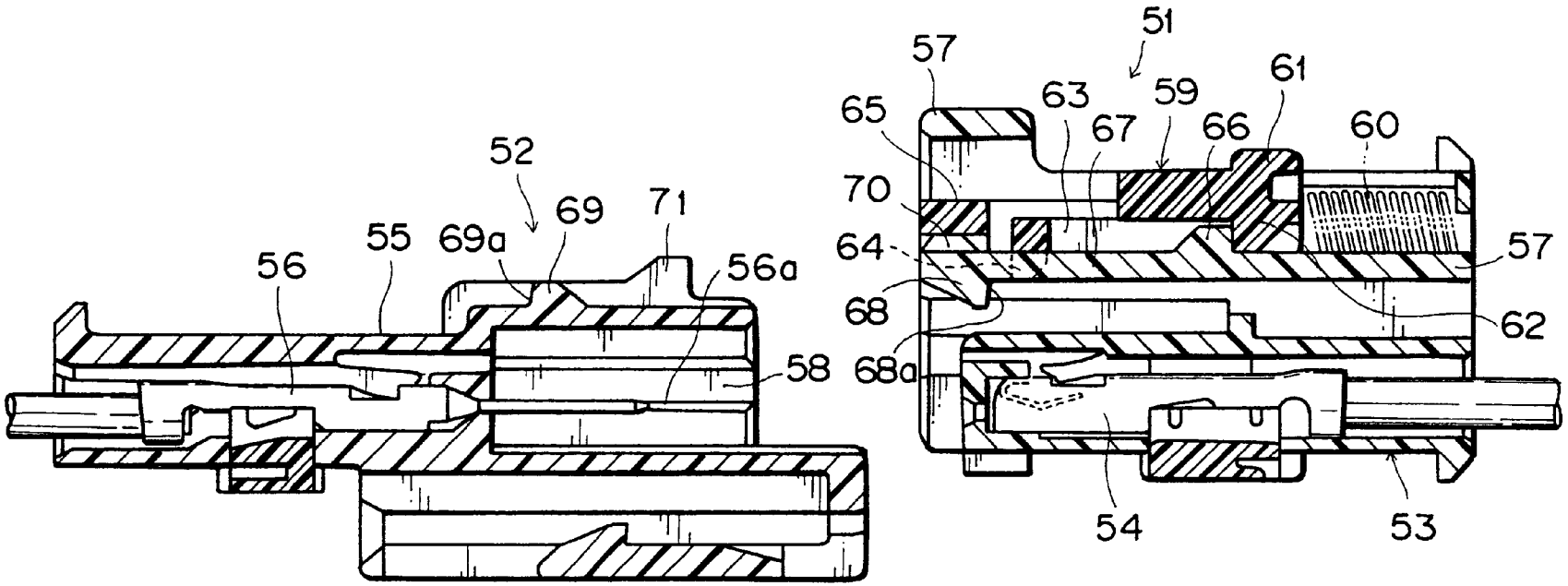
PRIOR ART FIG. 11
FIG. 11 is a longitudinal sectional view of a prior art semi-coupling detection connector.
Figure 12:
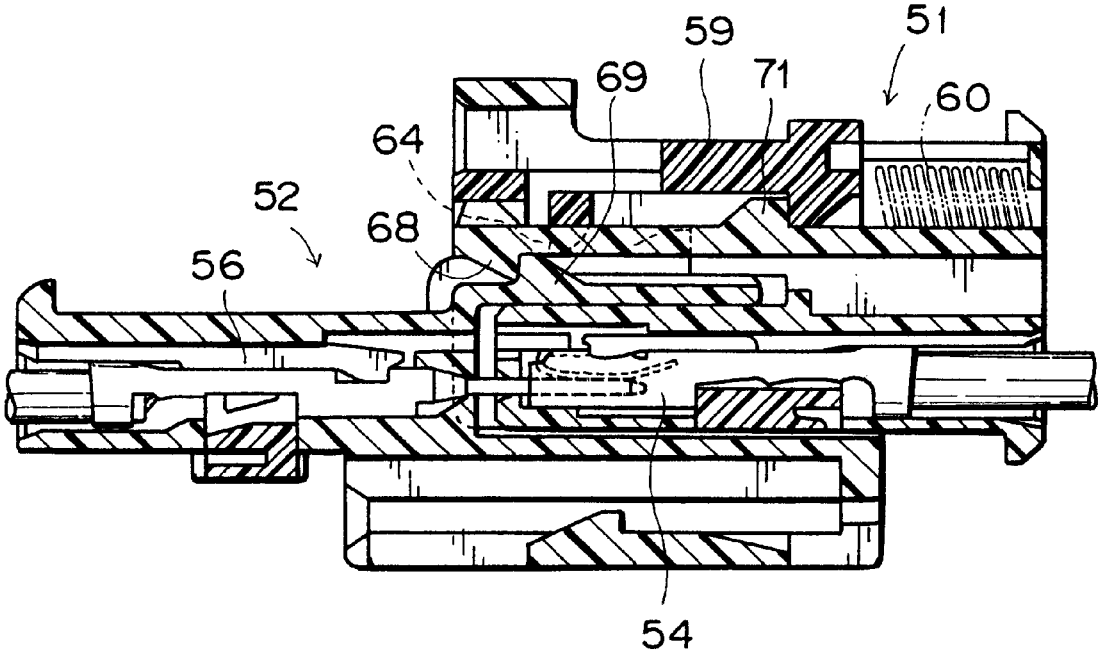
PRIOR ART FIG. 12
FIG. 12 is a longitudinal sectional view showing a coupled state of the prior art semi-coupling detection connector.

And, by pulling both the connectors 2,3 in the uncoupling direction as shown in FIG. 10, the connectors 2,3 are uncoupled, and therefore the connection of the terminals 9,12 is also released. The slider 4 returns forward by virtue of the coil spring 18 by releasing the projecting portion 22.

Here, the engaging planes 20*b*, 29*b* of the locking projections 20,29 may be a little slanted in a direction of hard unlocking so as to improve the lock force and to prevent a sudden lock release.

And, because the lock release operation (bending operation) of the locking arm 38 of the male connector 2 is forcibly carried out by the first and second guide sloping portions 27,28 of the slider 4, the lock release can be securely carried out. And, because the slide projection 40 for the first guide sloping portion 27 is provided on both sides of the locking arm 38, the twist of the locking arm 38 can be prevented, thereby making the lock release stable.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein. Incidentally, the contents of Japanese Patent Application No.?????? are hereby incorporated by reference.

What is claimed is:

1. A semi-coupling detection connector, comprising:

a first connector having a resilient locking arm;

a second connector having a first locking portion and being to be coupled with the first connector; and a slider provided on the first connector slidably in a connector coupling/uncoupling direction, wherein a second locking portion for the first locking portion is provided on the locking arm, a slide portion is provided, near the second locking portion, on a side portion of the locking arm, and a first guide sloping portion for the slide portion and a second guide sloping portion for the second locking portion are provided on the slider in a connector coupling direction.

2. The semi-coupling detection connector as set forth in claim 1, wherein the slider is energized in the connector coupling, direction.

3. The semi-coupling detection connector as set forth in claim 1, wherein the slide portion is provided on both sides of the locking arm.

4. The semi-coupling detection connector as set forth in claim 1, wherein a resilient abutting arm having a second abutting portion for the first abutting portion of the second connector is provided on the slider, the second abutting portion runs onto a guide portion of the first connector when the second locking portion runs onto the second sloping portion, and abutment between the second abutting portion and the first abutting portion is released.

5. The semi-coupling detection connector as set forth in claim 2, wherein a third abutting portion is provided on a bending side of the locking arm, an abutting portion for the third abutting portion is provided on the slider, and a slant plane of the abutting portion abuts another slant plane of the third abutting portion under the energization in an engaged state of the first and second locking portions.

6. The semi-coupling detection connector as set forth in claim 2, wherein a stopping portion is provided on the slider, and the stopping portion abuts the guide portion under the energization.

7. The semi-coupling detection connector as set forth in claim 1, wherein the first and second locking portions each have an engaging plane being vertical or slanted in a direction of hard unlocking.

8. The semi-coupling detection connector as set forth in claim 2, wherein the first and second locking portions each have an engaging plane being vertical or slanted in a direction of hard unlocking.

9. The semi-coupling detection connector as set forth in claim 3, wherein the first and second locking portions each have an engaging plane being vertical or slanted in a direction of hard unlocking.

10. The semi-coupling detection connector as set forth in claim 4, wherein the first and second locking portions each have an engaging plane being vertical or slanted in a direction of hard unlocking.

11. The semi-coupling detection connector as set forth in claim 5, wherein the first and second locking portions each have an engaging plane being vertical or slanted in a direction of hard unlocking.

12. The semi-coupling detection connector as set forth in claim 6, wherein the first and second locking portions each have an engaging plane being vertical or slanted in a direction of hard unlocking.

* * * * *